US009024935B2

(12) United States Patent
Ikeda et al.

(10) Patent No.: US 9,024,935 B2
(45) Date of Patent: May 5, 2015

(54) IMAGE DISPLAY APPARATUS AND IMAGE CORRECTION METHOD

(75) Inventors: Hiroaki Ikeda, Tokyo (JP); Shigenobu Jyou, Tokyo (JP); Reiichi Kobayashi, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 751 days.

(21) Appl. No.: 13/260,301

(22) PCT Filed: Mar. 27, 2009

(86) PCT No.: PCT/JP2009/056220

§ 371 (c)(1),
(2), (4) Date: Sep. 24, 2011

(87) PCT Pub. No.: WO2010/109643

PCT Pub. Date: Sep. 30, 2010

(65) Prior Publication Data

US 2012/0019507 A1 Jan. 26, 2012

(51) Int. Cl.
*G09G 3/36* (2006.01)

(52) U.S. Cl.
CPC ..... *G09G 3/3611* (2013.01); *G09G 2320/0257* (2013.01); *G09G 2320/0261* (2013.01); *G09G 2360/16* (2013.01)

(58) Field of Classification Search
CPC ..... G09G 2330/021; G09G 3/3696; G09G 3/3233
USPC ..... 345/87–100, 204, 212, 214
See application file for complete search history.

(56) References Cited

U.S. PATENT DOCUMENTS 7,283,179 B2 10/2007 Suzuki
(Continued)

FOREIGN PATENT DOCUMENTS

| | | | |
|---|---|---|---|
| CN | 101089942 | A | 12/2007 |
| JP | 6-332399 | A | 12/1994 |
| JP | 2002-112070 | A | 4/2002 |
| JP | 2002-333858 | A | 11/2002 |

(Continued)
OTHER PUBLICATIONS

Chinese Office Action dated May 16, 2013, with English translation.

*Primary Examiner* — Kumar Patel
*Assistant Examiner* — Mansour M Said
(74) *Attorney, Agent, or Firm* — McGinn IP Law Group, PLLC

(57) ABSTRACT

The present invention is aimed at appropriately suppressing display failure such as a tailing phenomenon and the like in a normally white type liquid crystal panel. A driver (3) supplies a drive voltage in conformity with an image signal received by an image signal processing circuit (1), to a liquid crystal panel (4). A histogram detector (5) detects a histogram representing the relationship between the signal level of the image signal received by the image signal processing circuit (1) and the number of pixels. A CPU (6) calculates, based on the histogram detected by the histogram detector (5), a first proportion of the number of pixels (on the white side) whose signal level is equal to or greater than a first defined value, to the total number of pixels of the histogram and a second proportion of the number of pixels (on the black side) whose signal level is equal to or smaller than a second defined value that is smaller than the first defined value, to the total number of pixels of the histogram. An amplifier (2) corrects the lower limit of the drive voltage that the driver (3) supplies to the liquid crystal panel (4) in accordance with the first proportion of white side pixels and second proportion of black side pixels calculated by CPU (6).

16 Claims, 7 Drawing Sheets

(56) References Cited

U.S. PATENT DOCUMENTS

| | | | | |
|---|---|---|---|---|
| 8,094,112 | B2 * | 1/2012 | Furuhashi et al. | 345/98 |
| 2003/0146919 | A1 | 8/2003 | Kawashima et al. | |
| 2005/0018094 | A1 | 1/2005 | Suzuki | |
| 2007/0103418 | A1 | 5/2007 | Ogino et al. | |
| 2007/0291053 | A1 * | 12/2007 | Kida et al. | 345/690 |
| 2010/0090928 | A1 * | 4/2010 | Maeda et al. | 345/4 |

FOREIGN PATENT DOCUMENTS

| | | | |
|---|---|---|---|
| JP | 2004-289746 | A | 10/2004 |
| JP | 2005-6038 | A | 1/2005 |
| JP | 2005-352482 | A | 12/2005 |
| JP | 2007-133051 | A | 5/2007 |
| JP | 2007-164208 | A | 6/2007 |
| JP | 2008-20887 | A | 1/2008 |

* cited by examiner

IMAGE DISPLAY APPARATUS AND IMAGE CORRECTION METHOD

TECHNICAL FIELD

The present invention relates to an image display apparatus having a normally white type liquid crystal panel and an image correction method.

BACKGROUND ART

FIG. 1 is an illustrative diagram schematically showing pixels of a liquid crystal panel used in an image display apparatus such as a liquid crystal projector or the like.

As shown in FIG. 1, each pixel of the liquid crystal panel includes pixel electrode 101, common electrode 102 opposing pixel electrode 101. Further, liquid crystal 103 is held between pixel electrode 101 and common electrode 102. Opening 104 for leading light incident into liquid crystal 103 is formed in each pixel while shade 105 for shielding light is formed between pixels. Though a transistor for applying a drive voltage in accordance with an image signal is connected to each pixel electrode 101, no transistors are illustrated in FIG. 1. The drive voltage is measured by taking the potential of common electrode 102 as a reference (0V).

When a drive voltage is applied to pixel electrode 101, a potential difference arises between pixel electrode 101 and common electrode 102, producing an electric field inside liquid crystal 103 for the potential difference. As the arrangement of molecules of liquid crystal 103 changes in accordance with this electric field (which will be referred to hereinbelow as longitudinal electric field), the amount of light incident on and transmitting through liquid crystal 103 varies so as to display an image represented by the image signal.

There are cases where a potential difference arises between pixel electrodes 101 adjacent to each other, producing an electric field inside liquid crystal 103 due to the potential difference. Since the arrangement of molecules of liquid crystal 103 also changes depending on this electric field (which will be referred to hereinbelow as transversal electric field), alignment failure of the molecules of liquid crystal 103 deviating from the ideal arrangement conforming to the longitudinal electric field may occur, possibly causing light leakage, or light to leak from pixels.

Such light leakage can be prevented if the light shielding range by shade 105 is greater than a certain extent. However, in recent years, image display apparatus have been developed that feature high luminosity, high resolution and miniaturization, and the result is tendency to make opening 104 greater. As a result, the range in which light is shielded by shade 105 becomes smaller, causing difficulties in preventing light leakage.

Now, a normally white type liquid crystal panel will be described. A normally white type liquid crystal panel is a liquid crystal panel that maximizes the amount of transmittance of light incident on liquid crystal 103 when no drive voltage is applied to pixel electrode 101.

It has been known as regards normally white type liquid crystal panels that when the drive voltage that is applied to pixel electrode 101 changes from near the minimum value to near the maximum value, light leakage occurs at the pixel of the pixel electrode 101, causing display failures such as a tailing phenomenon and the like. In a word, display failure occurs at a pixel that changes from the white image to the black image.

When the drive voltage applied to pixel electrode 101 changes from near the maximum value to near the minimum value, no display failure will occur. Also, when a drive voltage near the minimum is applied to pixel electrode 101 of a pixel in which display failure has occurred, so as to produce the white image, the display failure is resolved.

Hereinbelow, the drive voltage near the minimum value is called white side voltage, whereas the drive voltage near the maximum value is called black side voltage.

FIGS. 2A and 2B are illustrative diagrams for explaining one display failure example. In FIGS. 2A and 2B, a display image at a certain point of time when a white image triangular object is moving in a black image background is shown. Here, it is assumed that the object is moving from right to left in the drawing.

In this case, the normal display image free from display failure is given as the display image shown in FIG. 2A. However, since each pixel on the trace of the object changes from the white image to the black image, light leakage takes place. Accordingly, in each pixel on the trace of the object, the background of the black image cannot be correctly displayed, causing a tailing phenomenon, as shown in FIG. 2B.

In the above way, a tailing phenomenon occurs when an object of the white image moves in the black image; there are more occasions that objects of the white image move in the black image as the area of the black image is larger, hence display failures such as a tailing phenomenon and the like become more prone to occur. Further, since the smaller the area of the white image tone, the fewer will be the pixels that are display failure is unlikely to be resolved.

In order to suppress display failures such as a tailing phenomenon of this kind and the like, there is a known method of limiting the upper limit of the signal level of the image signal.

FIG. 3A is a waveform diagram showing a drive voltage when the upper limit of the signal level of the image signal is not limited. FIG. 3B is a waveform diagram showing a drive voltage when the upper limit of the signal level of the image signal is limited. Here, the image signal uses a 1H reversing drive mechanism in which the polarity is reversed every one horizontal period (1H). Also, the image signal indicates the white image.

When the upper limit of the signal level of the image signal is not limited, pixel electrode 101 is applied with the white side voltage as the drive voltage as shown in FIG. 3A, hence there is a possibility of display failure taking place. To deal with this, the upper limit of the signal level of the image signal is limited so that the drive voltage will not fall in the white side voltage, as shown in FIG. 3B. As a result, there occurs no change from the white side voltage to the black side voltage, thus making it possible to suppress display failure.

However, in the method of limiting the upper limit of the signal level, the drive voltage does not take a value around the minimum value, so that it is impossible to maximize the amount of transmittance of the light incident on liquid crystal 103. This means that the brightness of the display image cannot be maximized, hence causing the problem of the display image darkening.

Disclosed in Patent Document 1 is a liquid crystal television apparatus that can suppress display failures and darkening of the display image.

This liquid crystal television apparatus detects the average brightness of the image signal and increases the upper limit of the signal level of the image signal when the average brightness is equal to or greater than a predetermined threshold.

With this, the upper limit of the signal level becomes lower when the black image is predominant and hence display failure is likely to occur, so that display failure can be suppressed. On the other hand, the upper limit of the signal level becomes higher when the black image is not predominant and hence display failure is unlikely to occur, so that the display image becomes bright. Accordingly, it is possible to suppress occurrence of display failure and the display image from darkening.

Patent Document 1: JP2005-6038A.

DISCLOSURE OF THE INVENTION

Problems to be solved by the Invention

Since the average brightness also depends on the medium image between white and black images, if the average brightness is equal, there are cases, where the white image area is large and the black image area is small, and where the white image area is small and the black image area is large.

Further, even with the same average brightness, display failure is liable to occur when the white image area is small and the black image area is large than when the white image area is large and the black image area is small. However, in the liquid crystal television apparatus described in Patent Document 1, since the upper limit of the signal level of the image signal is modified based on the average brightness of the image signal, the brightness of the display image becomes equal between these cases. Accordingly, there is the problem in which display failure cannot be suppressed appropriately.

The object of the present invention is to solve the above problem or provide an image display apparatus and an image correction method for solving the problem in which display failure cannot be suppressed appropriately.

Means for Solving the Problems

An image display apparatus of the present invention includes: a liquid crystal panel; an input means receiving an image signal; a drive means supplying a drive voltage in conformity with the image signal received by the input means to the liquid crystal panel to display the image represented by the video signal on the liquid crystal panel; a detection means detecting a histogram representing the relationship between the signal level of the image signal received by the input means and the number of pixels; a calculation means calculating, based on the histogram detected by the detection means, a first proportion of the number of pixels whose signal level is equal to or greater than a predetermined first defined value, to the total number of pixels of the histogram and a second proportion of the number of pixels whose signal level is equal to or smaller than a second defined value that is smaller than the first defined value, to the total number of pixels of the histogram; and, a correction means correcting the lower limit of the drive voltage that the drive means supplies to the liquid crystal panel in accordance with the first proportion and second proportion calculated by the calculation means.

An image correction method of the present invention is an image correction method performed by an image display apparatus that supplies a drive voltage in accordance with an image signal to a normally white type liquid crystal panel to display the image represented by the image signal on the liquid crystal panel, comprising the steps of; detecting a histogram representing the relationship between the signal level of the image signal and the number of pixels; calculating, based on the detected histogram, a first proportion of the number of pixels whose signal level is equal to or greater than a predetermined first defined value, to the total number of pixels of the histogram and a second proportion of the number of pixels whose signal level is equal to or smaller than a second defined value that is smaller than the first defined value, to the total number of pixels of the histogram; and correcting the lower limit of the drive voltage that is supplied to the liquid crystal panel, in accordance with the calculated first proportion and second proportion.

Effect of the Invention

According to the present invention, it is possible to suppress display failure appropriately.

THE BEST MODE FOR CARRYING OUT THE INVENTION

Figure 1:
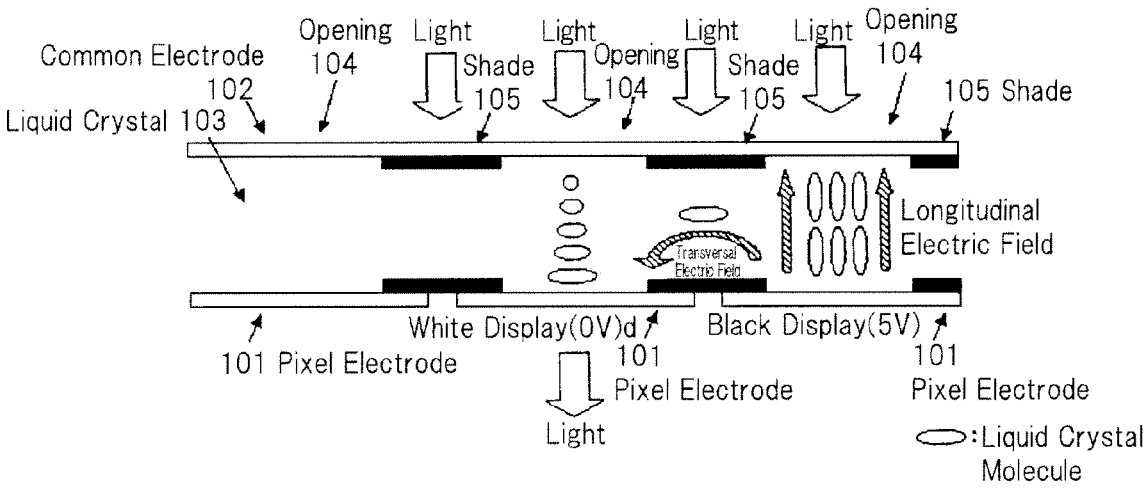
FIG. 1 is an illustrative diagram schematically showing pixels of a liquid crystal panel.
Figure 2A:
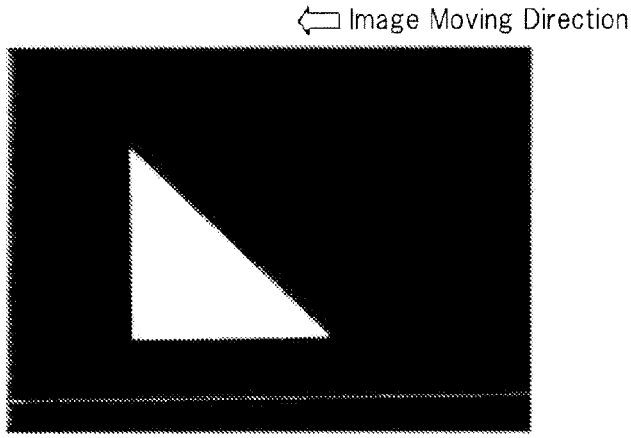
FIG. 2A is an illustrative diagram showing a normal image free from display failure.
Figure 2B:
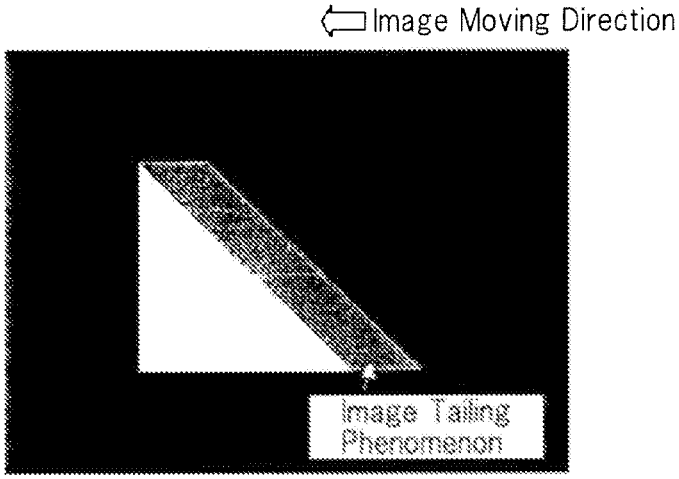
FIG. 2B is an illustrative diagram showing one example of display failure.
Figure 3A:
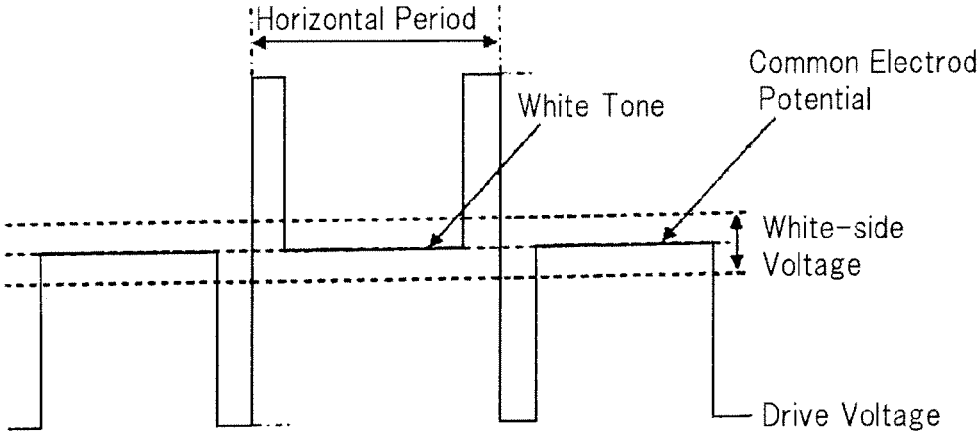
FIG. 3A is a waveform in diagram of an image signal that is not limited as to amplitude.
Figure 3B:
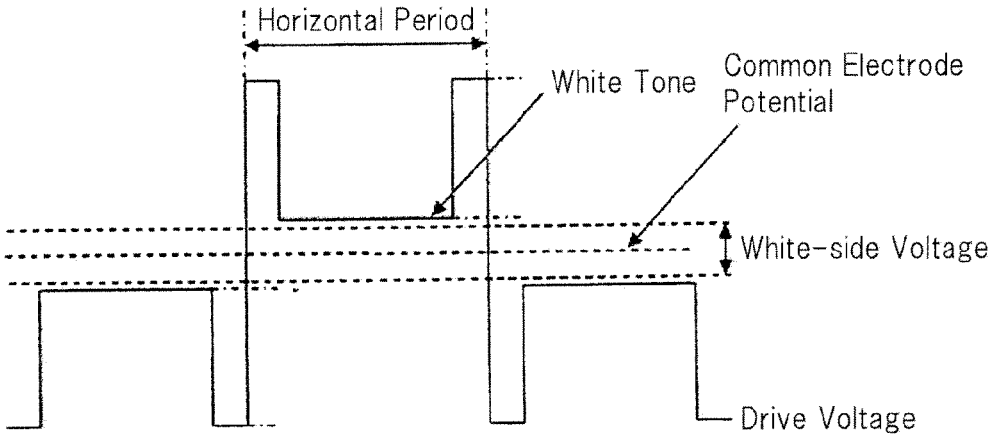
FIG. 3B is a waveform diagram of an image signal that is limited as to amplitude.

Next, the exemplary embodiments of the present invention will be described with reference to the drawings. In the description hereinbelow, the components having the same functions are allotted with the same reference numerals and their description may be omitted.

Figure 4:
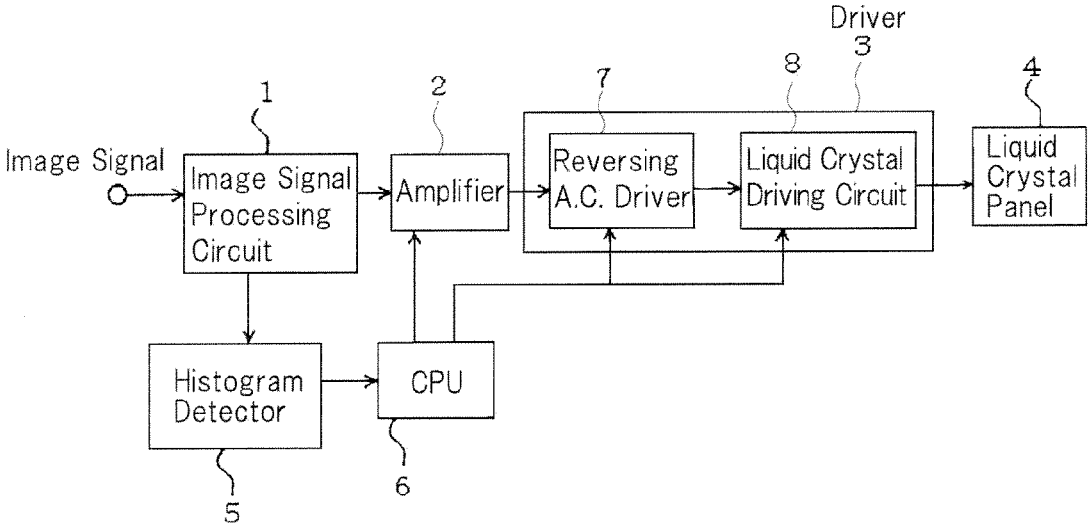
FIG. 4 is a block diagram showing a configuration of an image display apparatus according to the first exemplary embodiment of the present invention.

FIG. 4 is a block diagram showing a configuration of an image display apparatus according to the first exemplary embodiment of the present invention. In FIG. 4, the image display apparatus includes image signal processing circuit 1, amplifier 2, driver 3, liquid crystal panel 4, histogram detector 5 and CPU 6.

Image signal processing circuit 1 is an example of input means. Image signal processing circuit 1 receives an image signal. Image signal processing circuit 1 performs signal processing of the received image signal. For example, image signal processing circuit 1 performs gamma correction, D/A conversion and like as the signal processing. Here, the image signal after signal processing is assumed to be a d.c. signal.

Amplifier 2 is an example of correction means. Amplifier 2 amplifies the image signal to correct the white level of the image signal. Here, the white level is the amplitude when the image signal is the brightest.

Driver 3 supplies a drive voltage in conformity with the image signal whose white level has been corrected by amplifier 2, to liquid crystal panel 4 so as to display the image represented by the image signal, on liquid crystal panel 4.

Liquid crystal panel 4 is a normally white type liquid crystal panel. Therefore, the image displayed on liquid crystal panel 4 becomes brighter as the drive voltage lowers, and becomes brightest at the lower limit of the drive voltage. That is, the white level of the image signal corresponds to the lower limit of the drive voltage. Accordingly, amplifier 2 corrects the white level of the image signal, to thereby correct the lower limit of the drive voltage.

More specifically, driver 3 includes reversing a.c. driver 7 and liquid crystal driving circuit 8, each component performing the following process.

Reversing a.c. driver 7 converts the image signal whose amplitude has been corrected by amplifier 2 into an a.c. signal that reverses its polarity in a predetermined cycle. The predetermined cycle is, for example one horizontal period, one field period or the like.

Liquid crystal driving circuit 8 generates a drive voltage in conformity with the image signal that has been converted to the a.c. signal by reversing a.c. driver 7. Liquid crystal driving circuit 8 supplies the drive voltage to liquid crystal panel 4 so as to display the image represented by the image signal on liquid crystal panel 4.

Histogram detector 5 is one example of the detection means. Histogram detector 5 detects an image histogram that presents the relationship between the signal level of the image signal that has been subjected to signal processing in image signal processing circuit 1 and the number of pixels. Here, histogram detector 5 preferably detects an image histogram for every frame.

Here, histogram detector 5 may detect, as an image histogram(s) a plurality of histograms for individual colors, representing the numbers of pixels depending on the signal level of respective color component signals included in the image signal, or may detect the luminosity histogram representing the number of pixels depending on the signal level of the luminance signal included in the image signal.

CPU 6 is one example of the calculation means. CPU 6, based on the image histogram detected by histogram detector 5, calculates the proportion of white side pixels and the proportion of black side pixels to the total number of the pixels of the image histogram.

The white side pixel is a pixel having a signal level equal to or greater than a first defined value. The black side pixel is a pixel having a signal level equal to or smaller than a second defined value. Here, the second defined value is smaller than the first defined value. Further, the first defined value is, for example, 80% of the maximum signal level. The second defined value is, for example, 20% of the maximum signal level. Here, the proportion of the white side pixels is one example of the first proportion and the proportion of black side pixels is one example of the second proportion.

CPU 6 deter mines the correction quantity to the white level of the image signal by amplifier 2, in accordance with the calculated proportion of white side pixels and proportion of black side pixels. The correction quantity represents the proportion of the white level of the image signal after correction to the white level of the image signal before correction. As a result, amplifier 2 functions to correct the white level of the image signal in accordance with the proportion of white side pixels and the proportion of black side pixels.

For example, when the proportion of black side pixels is equal to or greater than a predetermined threshold, CPU 6 adjusts the correction quantity so that the lower limit of the drive voltage becomes equal to a predetermined value. When the proportion of black side pixels is less than the threshold, CPU 6 adjusts the correction quantity so that the lower limit of the drive voltage is equal to or lower than the predetermined value and becomes smaller as the proportion of white side pixels is greater. Further, when the proportion of black side pixels is less than the threshold. CPU 6 adjusts the lower limit of the drive voltage to become smaller as the proportion of black side pixels becomes smaller. It should be noted that the greater the correction quantity, the smaller the lower limit of the drive voltage.

Figure 5:
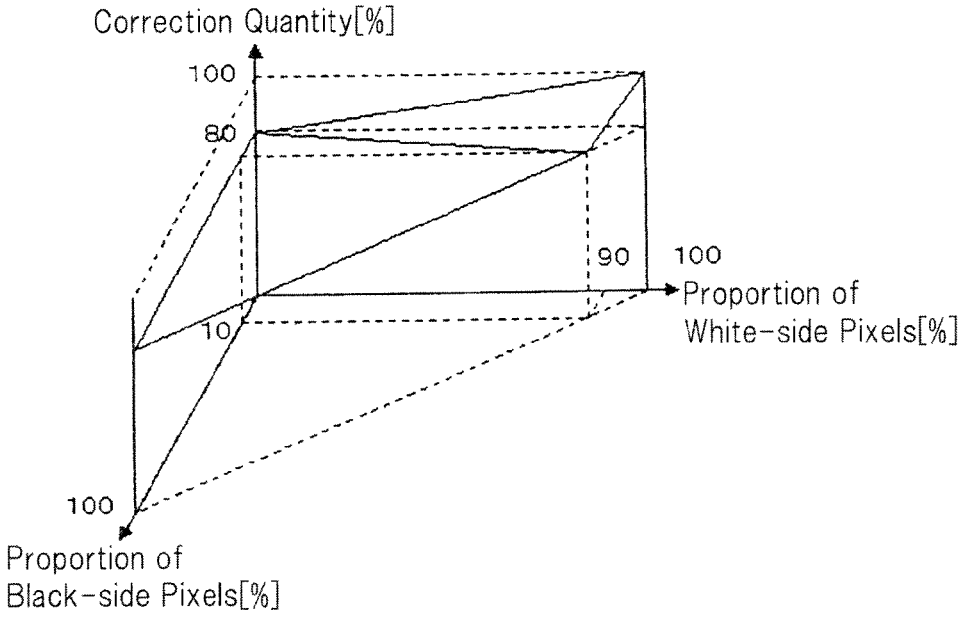
FIG. 5 is an illustrative diagram showing the relationship between the correction quantity to the white level and the image histogram proportion.

FIG. 5 is an illustrative diagram showing the relationship between the correction quantity and the proportion of black level pixels and the proportion of the white level pixels.

In FIG. 5, the threshold is 10% while the correction quantity corresponding to the predetermined value is set at 80%. When the proportion of white side pixels is 100%, the correction quantity is set at 100%. That is, the white level after correction is made equal to the white level before correction.

In this case, when the proportion of black side pixels is equal to or lower than 10%, the correction quantity is 80%. When the proportion of black side pixels is 0% to 10%, the correction quantity changes from 80% to 100% in accordance with the proportion of white side pixels and the proportion of black side pixels Returning to FIG. 4, when histogram detector 5 detects a plurality of histograms for individual colors as the image histograms, CPU 6 determines the correction quantity for each individual color histogram, based on the individual color histogram. In a case where these correction quantities differ, if the white level for each color-component signal is corrected separately, the white levels of individual color signals deviate from each other, possibly causing color shear. In order to prevent this color shear, CPU 6 adjusts the correction quantity of amplifier 2 to the least correction quantity among those amounts of correction to thereby maximize the lower limit of the drive voltage.

For example, the proportions of the white side pixels are equal to each other while, when the proportions of the black side pixels are "0%" for red, "5%" for green and "10%" for blue, CPU 6 adjusts the correction quantity of amplifier 2 in conformity with the individual color histogram for blue.

Further, the correction quantity of amplifier 2 has been adjusted so that the lower limit of the drive voltage falls at the predetermined value, and the proportion of black side pixels becomes zero, then CPU 6 may adjust that correction quantity so that the lower limit of the drive voltage will become gradually smaller. For example, CPU 6 may increase the correction quantity to 100% by taking some seconds so that the lower limit of the drive voltage will take the minimum value "0".

CPU 6 also controls reversing a.c. driver 7 and liquid crystal driving circuit 8 as appropriate, such as on-off control, settings for the driving method, etc., of reversing a.c. driver 7 and liquid crystal driving circuit 8.

Next, the operation will be described.

Figure 6:
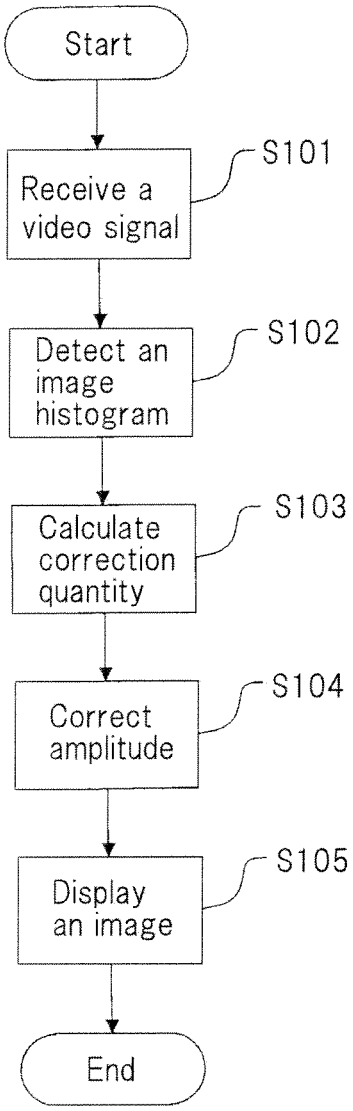
FIG. 6 is a flow chart for illustrating an operational example of an image display apparatus.

FIG. 6 is a flow chart for illustrating the operation of the image display apparatus.

In Step S101, image signal processing circuit 1, which receives an image signal, performs various signal processes 1 of the image signal and outputs the signal-processed image signal to amplifier 2 and histogram detector 5. Histogram detector 5, which receives the image signal, executes Step S102.

In Step S102, histogram detector 5 detects an image histogram based on the image signal. For the image histogram, whether histograms for individual colors are detected or whether a luminance histogram is detected, may have been determined beforehand, or may be set by the user of the image display apparatus.

Histogram detector 5, as receiving the image histogram, outputs the image histogram to CPU 6. CPU 6, as receiving the image histogram, executes Step S103.

In Step S103, CPU 6, based on the image histogram, calculates the proportion of white side pixels and the proportion of black side pixels to the total number of pixels in the image histogram. CPU 6, based on the calculated proportion of white side pixels and proportion of black side pixels, determines the correction quantity to the white level of the image signal by amplifier 2.

CPU 6 outputs the correction quantity to amplifier 2. Amplifier 2, which receives the correction quantity and the image signal output from image signal processing circuit 1 at Step S1, executes Step S104.

In Step S104, amplifier sets the correction quantity to itself. Then, amplifier 2 corrects the white level of the image signal to the set correction quantity. Here, it is preferable to delay the image signal using a frame memory or the like in order to correct the white level of the frame that was used to determine the correction quantity, to the determined correction quantity.

After correcting the white level of image signal, amplifier 2 outputs the image signal with its white level corrected, to reversing a.c. driver 7. Reversing a.c. driver 7, as receiving the image signal, executes Step S105.

In Step S105, reversing a.c. driver 7 converts the image signal to an a.c. signal that reverses its polarity in a predetermined cycle and outputs the converted image signal to liquid crystal driving circuit 8. Liquid crystal driving circuit 8, as receiving the image signal, generates a drive voltage in accordance with the image signal, and supplies the drive voltage to liquid crystal panel 4.

Liquid crystal panel 4 is driven in accordance with the supplied drive voltage so as to display the image represented by the image signal to complete the operation.

Next, the effect will be described.

Driver 3 supplies a drive voltage in conformity with the image signal received by image signal processing circuit 1 to liquid crystal panel 4 so as to display the image represented by the image signal on liquid crystal panel 4. Histogram detector 5 detects an image histogram that represents the relationship between the signal level of the image signal that has been received by image signal processing circuit 1 and the number of pixels. CPU 6, based on the image histogram detected by histogram detector 5, calculates the proportion of pixels (white side pixels) whose signal level is equal to or greater than the first defined value, to the total number of pixels in the histogram and the proportion of pixels (black side pixels) whose signal level is equal to or smaller than the second defined value that is smaller than the first defined value, to the total number of pixels in the histogram. Amplifier 2 corrects the lower limit of the drive voltage that driver 3 supplies to liquid crystal panel 4, in accordance with the proportion of white side pixels and proportion of black side pixels, which were calculated by CPU 6.

In this case, the lower limit of the drive voltage is corrected in accordance with the proportion of white side pixels and proportion of black side pixels. Accordingly, it is possible to appropriately determine an image with which display failure is prone to occur, it is hence possible to appropriately suppress display failure.

Further, in the present exemplary embodiment, when the proportion of black side pixels is equal to or greater than a threshold, amplifier 2 sets the lower limit of the drive voltage at a predetermined value. When the proportion of black side pixels is less than a threshold, the amplifier sets the lower limit of the drive voltage equal to or lower than a predetermined value and decreases the lower limit as the proportion of white side pixels becomes greater.

In this case, since the lower limit of the drive voltage becomes lower as the proportion of white side pixels becomes greater, it is possible to make the display image brighter as the proportion of white side pixels becomes greater. Accordingly, it is possible to appropriately suppress display failure whilst inhibiting the display image from darkening.

Further, in the present exemplary embodiment, when the proportion of black side pixels is less than a threshold, amplifier 2 makes the lower limit of the drive voltage lower as the proportion of black side pixels becomes smaller.

In this case, it is possible to make the display image brighter as the proportion of black side pixels is smaller. Accordingly, it is possible to appropriately suppress display failure while inhibiting the display image from darkening.

Further, in the present exemplary embodiment, amplifier 2 corrects the lower limit of the drive voltage by correcting the white level of the image signal. In this case, it is possible to readily correct the amplitude of the drive voltage.

Next, the second exemplary embodiment will be described.

Though in the first exemplary embodiment, the white level of the image signal is corrected to correct the lower limit of the drive voltage, in the present exemplary embodiment, the lower limit of the drive voltage is limited by superposing a d.c. voltage on the drive voltage.

Figure 7:
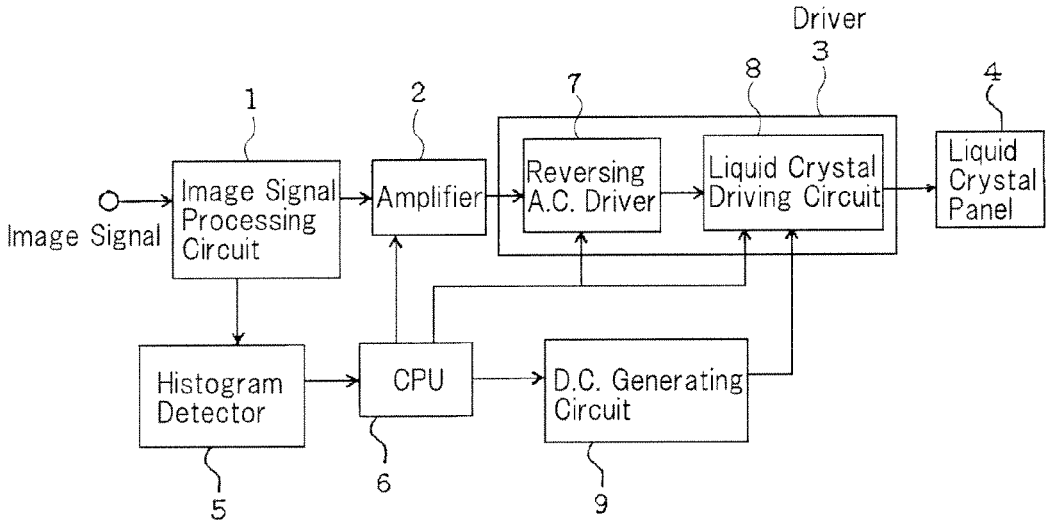
FIG. 7 is a block diagram showing a configuration of an image display apparatus of the second exemplary embodiment of the present invention.

FIG. 7 is a block diagram showing the configuration of an image display apparatus of the present exemplary embodiment. In FIG. 7, the image display apparatus further includes d.c. generating circuit 9, in addition to the configuration shown in FIG. 4. Here, in amplifier 2 of the present exemplary embodiment, the amplitude of the white level of the image signal is set to the minimum value (0V).

D.C. generating circuit 9 is one example of the correction means. D.C. generating circuit 9 generates a d.c. voltage to be superposed on the drive voltage in accordance with the image signal whose signal level is equal to or greater than a predetermined level and superposes the d.c. voltage on the drive voltage generated by liquid crystal driving circuit 8. As a result, the lower limit of the drive voltage is corrected.

CPU 6 adjusts the magnitude of the d.c. voltage generated by d.c. generating circuit 9, in accordance with the calculated proportion of white side pixels and proportion of black side pixels. With this, d.c. generating circuit 9 superposes the d.c. voltage on the drive voltage in accordance with the image signal whose signal level is equal to or greater than a predetermined level, to thereby correct the amplitude of the drive voltage.

Figure 8:
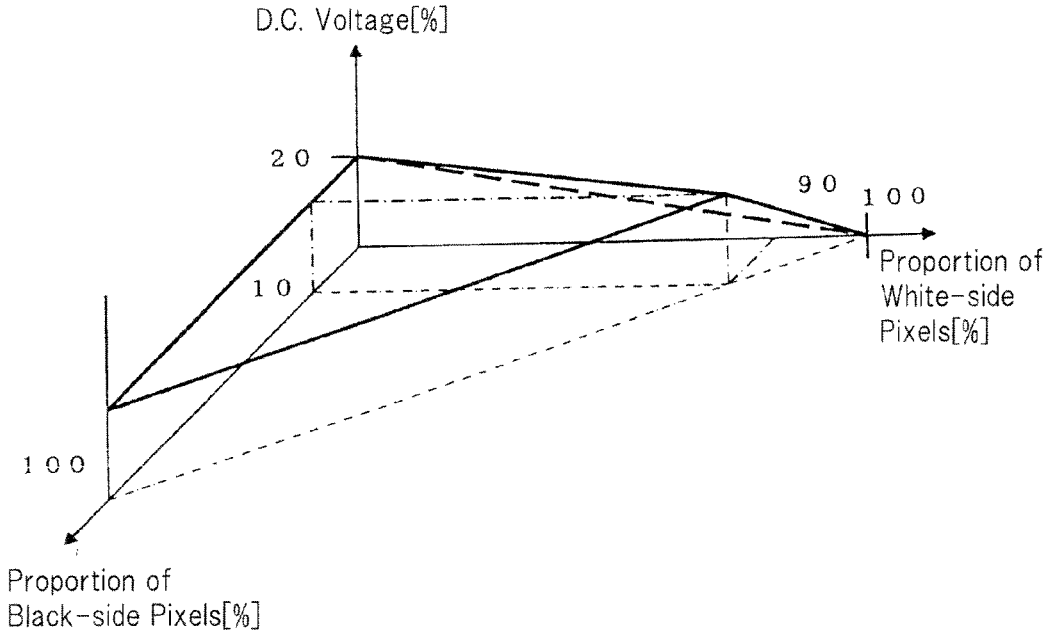
FIG. 8 is an illustrative diagram showing the relationship between the magnitude of d.c. voltage and an image histogram.

FIG. 8 is an illustrative diagram showing the relationship between the magnitude of the d.c. voltage, the proportion of black side pixels and the proportion of white side pixels. Here, the magnitude of the d.c. voltage is represented by its proportion to the maximum value of the amplitude of the drive voltage.

In FIG. 8, the threshold is 10%. The magnitude of the d.c. voltage corresponding to the predetermined value is set at 20% of the amplitude of the drive voltage. When the proportion of white side pixels is 100%, the magnitude of the d.c. voltage is set at 0%.

In this case, when the proportion of black side pixels is equal to or lower than 10%, the magnitude of the d.c. voltage is 20%©. When the proportion of black side pixels is 0% to 10%, the magnitude of the d.c. voltage varies from 0% to 20% in accordance with the proportion of white side pixels and the proportion of black side pixels.

The magnitude of the d.c. voltage has been adjusted so that the lower limit of the drive voltage falls at the predetermined value, and the proportion of black side pixels becomes zero, then CPU 6 may adjust that d.c. voltage so that the lower limit of the drive voltage will become gradually smaller. For example, CPU 6 may lower the magnitude of the d.c. voltage to 0 by taking some seconds so that the lower limit of the drive voltage will become the minimum value "0".

Next, the effect will be described.

In the present exemplary embodiment, d.c. generating circuit 9 superposes a d.c. voltage on the drive voltage in accordance with the image signal whose signal level is equal to or greater than a predetermined level, to thereby correct the amplitude of the drive voltage.

In this case, it is possible to correct the amplitude of the drive voltage without correcting the amplitude of the image signal.

Next, the third exemplary embodiment will be described.

Figure 9:
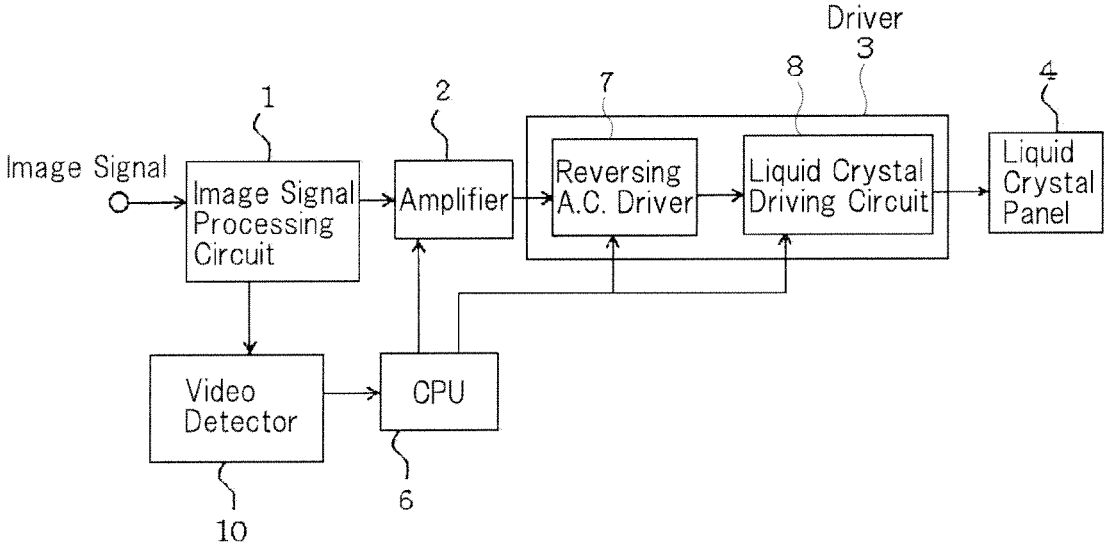
FIG. 9 is a block diagram showing a configuration of an image display apparatus of the third exemplary embodiment of the present invention.

FIG. 9 is a block diagram showing a configuration of an image display apparatus of the third exemplary embodiment of the present invention. In FIG. 9, the image display apparatus includes video detector 10 instead of histogram detector 5 in the configuration shown in FIG. 1.

Video detector 10 determines whether the image represented by the image signal that has been signal-processed by image signal processing circuit 1 is a video image or a still image.

For example, video detector 10 detects the APL or image histogram of the image signal frame every frame as a video decision value, and determines the difference between the video decision value of the current frame and the video decision value of the next frame. When this difference is greater than a predetermined value, the image represented by the image signal is determined as a video image. Then this difference is smaller than the value, the image represented by the image signal is determined as a still image.

Further video detector 10 may determine whether the image signal represents a video image or still image, by checking the image signal format, based on the polarity and the format (separate, composite, Synchronization-on-G, or the like) of the synchronization signal of the image signal, or the type of input terminal (VIDEO/S-VIDEO input terminal, Component input terminal and HDMI input terminal) through which the video signal is input. In this case, if the format of the image signal is a video format such as 1080p, 720p or the like, video detector 10 deter nines that the image represented by the image signal is a video image.

When the image represented by the image signal is a video image, video detector 10 detects the image histogram of the image signal, similarly to histogram detector 5 in FIG. 4.

When video detector 10 generates an image histogram, CPU 6 adjusts the correction quantity of the white level of the image signal by amplifier 2, similarly to the first exemplary embodiment. Thereby, when the image is determined as a video image at video detector 10, amplifier 2 corrects the lower limit of the drive voltage.

When the image represented by the image signal is a still image, CPU 6 will not perform any adjustment of correction quantity. In this case, amplifier 2 minimizes the amplitude of the white level of the image signal.

Here, when the image represented by the image signal has been determined as a video image at video detector 10, CPU 10 may adjust the correction quantity so that the white level of the image signal will take a constant value not depending on the image histogram (the proportion of white side pixels and the proportion of black side pixels). This is because brightness is more difficult to detect for a video image than a still image in view of a person's visual characteristics, a person is unlikely to detect that effect even if the screen is made dark.

Though in the present exemplary embodiment, histogram detector 5 in the first exemplary embodiment is replaced by video detector 10, histogram detector 5 in the second exemplary embodiment may be replaced by video detector 10.

Next, the effect will be described.

In the present exemplary embodiment, video detector 10 determines whether the image represented by the image signal is a video image or still image. When the image is determined as a video image by video detector 10, amplifier 2 corrects the lower limit of the drive voltage.

In this case, the screen can be made brighter in the case of a still image with which display failure such as a tailing phenomenon or the like is unlikely to occur while display failure can be appropriately suppressed in the case of a video image with which display failure such as a tailing phenomenon or the like is prone to occur In each of the exemplary embodiments described heretofore, the illustrated configuration is a mere example and the present invention should not be limited to the configuration.

What is claimed is:

1. An image display apparatus, comprising:

a normally white type liquid crystal panel;

an input unit that receives an image signal;

a drive unit that supplies a drive voltage in conformity with the image signal received by the input unit to the liquid crystal panel to display an image represented by the image signal on the liquid crystal panel;

a detection unit that detects a histogram representing a relationship between a signal level of the image signal received by the input unit and a number of pixels;

a calculation unit that calculates, based on the histogram detected by the detection unit, a first proportion of a number of pixels whose signal level is equal to or greater than a predetermined first defined value, to a total number of pixels of the histogram, and a second proportion of a number of pixels whose signal level is equal to or smaller than a second defined value that is smaller than the first defined value, to the total number of pixels of the histogram; and a correction unit that corrects a lower limit of the drive voltage that the drive unit supplies to the liquid crystal panel in accordance with the first proportion and second proportion calculated by the calculation unit, wherein the first proportion of the number of pixels includes a proportion of white side pixels to the total number of the pixels of the image histogram, wherein the second proportion of the number of pixels includes a proportion of black side pixels to the total number of the pixels of the image histogram, and wherein, after the correction unit corrects the lower limit of the drive voltage to fall at a predetermined value, and the proportion of black side pixels becomes zero, the correction unit gradually reduces the lower limit of the drive voltage.

2. The image display apparatus according to claim 1, wherein, when the second proportion is equal to or greater than a predetermined threshold, the correction unit sets the lower limit of the drive voltage at a predetermined value, and when the second proportion is less than the threshold, the correction unit sets the lower limit of the drive voltage to be equal to or lower than the predetermined value and makes the lower limit of the drive voltage smaller as the first proportion becomes greater.

3. The image display apparatus according to claim 2, wherein, when the second proportion is less than the threshold the correction unit makes the lower limit of the drive voltage smaller as the second proportion becomes smaller.

4. The image display apparatus according to claim 1, wherein the correction unit corrects a white level of the image signal to thereby correct the lower limit of the drive voltage.

5. The image display apparatus according to claim 1, wherein the correction unit corrects the lower limit of the drive voltage by superposing a d.c. voltage on the drive voltage in accordance with a video signal whose signal level is equal to or greater than a predetermined level.

6. The image display apparatus according to claim 5, wherein the correction unit adjusts a magnitude of the d.c. voltage in accordance with the first proportion and second proportion calculated by the calculation unit.

7. The image display apparatus according to claim 1, wherein the detection unit determines whether the image represented by the image signal comprises a video image or a still image, and the correction unit corrects the lower limit of the drive voltage when the image is determined to comprise the video image at the detection unit.

8. The image display apparatus according to claim 1, wherein the correction unit corrects a white level of the image signal in accordance with the proportion of white side pixels and the proportion of black side pixels.

9. The image display apparatus according to claim 1, wherein the correction unit corrects the lower limit of the drive voltage by correcting a white level of the image signal.

10. An image correction method performed by an image display apparatus that supplies a drive voltage in accordance with an image signal to a normally white type liquid crystal panel to display an image represented by the image signal on the liquid crystal panel, said method comprising:

detecting a histogram representing a relationship between a signal level of the image signal and the number of pixels;

calculating, based on the detected histogram, a first proportion of a number of pixels whose signal level is equal to or greater than a predetermined first defined value, to a total number of pixels of the histogram, and a second proportion of a number of pixels whose signal level is equal to or smaller than a second defined value that is smaller than the first defined value, to the total number of pixels of the histogram; and correcting a lower limit of the drive voltage that is supplied to the liquid crystal panel, in accordance with the calculated first proportion and second proportion, wherein the first proportion of the number of pixels includes a proportion of white side pixels to the total number of the pixels of the image histogram, wherein the second proportion of the number of pixels includes a proportion of black side pixels to the total number of the pixels of the image histogram, and wherein, in said correcting, the lower limit of the drive voltage is lowered as the proportion of white side pixels increases.

11. The image correction method according to claim 10, wherein, in the correcting, the lower limit of the drive voltage is corrected by superposing a d.c. voltage on the drive voltage in accordance with a video signal whose signal level is equal to or greater than a predetermined level.

12. The image correction method according to claim 10, further comprising determining whether the image represented by the image signal comprises a video image or a still image, wherein, in the correcting, the lower limit of the drive voltage is corrected when the image is determined to comprise the video image.

13. The image correction method according to claim 10, wherein, in said correcting, a white level of the image signal is corrected in accordance with the proportion of white side pixels and the proportion of black side pixels.

14. The image correction method according to claim 10, wherein, in said correcting, after the lower limit of the drive voltage is corrected to fall at a predetermined value, and the proportion of black side pixels becomes zero, the lower limit of the drive voltage is reduced.

15. The image correction method according to claim 10, wherein, in said correcting, the lower limit of the drive voltage is corrected by correcting a white level of the image signal.

16. An image display apparatus, comprising a normally white type liquid crystal panel;

an input unit that receives an image signal;

a drive unit that supplies a drive voltage in conformity with the image signal received by the input unit to the liquid crystal panel to display an image represented by the image signal on the liquid crystal panel;

a detection unit that detects a histogram representing a relationship between a signal level of the image signal received by the input unit and a number of pixels;

a calculation unit that calculates, based on the histogram detected by the detection unit, a first proportion of a number of pixels whose signal level is equal to or greater than a predetermined first defined value, to a total number of pixels of the histogram, and a second proportion of a number of pixels whose signal level is equal to or smaller than a second defined value that is smaller than the first defined value, to the total number of pixels of the histogram; and a correction unit that corrects a lower limit of the drive voltage that the drive unit supplies to the liquid crystal panel in accordance with the first proportion and second proportion calculated by the calculation unit, wherein the first proportion of the number of pixels includes a proportion of white side pixels to the total number of the pixels of the image histogram, wherein the second proportion of the number of pixels includes a proportion of black side pixels to the total number of the pixels of the image histogram, and wherein the correction unit lowers the lower limit of the drive voltage as the proportion of white side pixels increases.

* * * * *